US005374781A

United States Patent [19]

Dohnal et al.

[11] Patent Number: 5,374,781

[45] Date of Patent: Dec. 20, 1994

[54] CONTACT ASSEMBLY FOR SELECTOR OF STEP TRANSFORMER

[75] Inventors: Dieter Dohnal, Lappersdorf; Leonhard Pillmeier, Regensburg, both of Germany

[73] Assignee: Maschinenbaufabrik Reinhausen GmbH, Regensburg, Germany

[21] Appl. No.: 968,424

[22] Filed: Oct. 29, 1992

[30] Foreign Application Priority Data

Nov. 19, 1991 [DE] Germany ..... 4138000

[51] Int. Cl.[5] ..... H01B 17/26

[52] U.S. Cl. ..... 174/153 R

[58] Field of Search ..... 174/153 R, 65 R, 151, 174/152 E; 361/119, 120, 124, 35; 336/5; 439/571-575

[56] References Cited

U.S. PATENT DOCUMENTS

| | | | |
|---|---|---|---|
| 3,975,579 | 8/1976 | Davis et al. | 174/18 |
| 4,025,714 | 5/1977 | Quick et al. | 174/18 |
| 4,031,311 | 6/1977 | Mazanek | 174/31 R |
| 4,120,555 | 10/1978 | Shiflett et al. | 339/126 R |
| 5,272,280 | 12/1993 | Cosley et al. | 174/65 R |

FOREIGN PATENT DOCUMENTS

| | | |
|---|---|---|
| 9010730 | 9/1991 | Germany . |
| 3801152C2 | 10/1992 | Germany . |

*Primary Examiner*—Leo P. Picard
*Assistant Examiner*—Christopher Horgan
*Attorney, Agent, or Firm*—Herbert Dubno; Andrew Wilford

[57] ABSTRACT

A step-transformer drum formed with throughgoing apertures each centered on a respective axis has a contact assembly in each aperture having an insulating washer lining the aperture and having an inside part lying on an inside surface of the drum and an outside part lying on an outside surface of the drum. A stud has an enlarged head bearing outward on the inside washer part and a shaft projecting through the washer past the outside washer part and formed outside the outside washer part with a transversely throughgoing hole. A pin extends transversely through the hole and bears inwardly on an outwardly directed ramp so that rotation of the stud and pin in one direction relative to the structure makes the pin ride up on the ramp and tightens the stud in the aperture and opposite relative rotation loosens the stud.

14 Claims, 4 Drawing Sheets

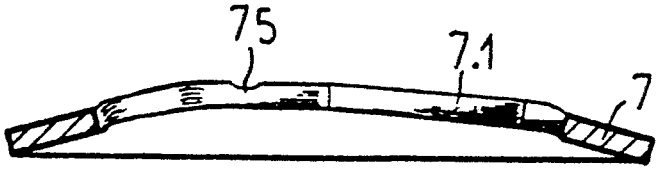
FIG. 4b
FIG. 4a
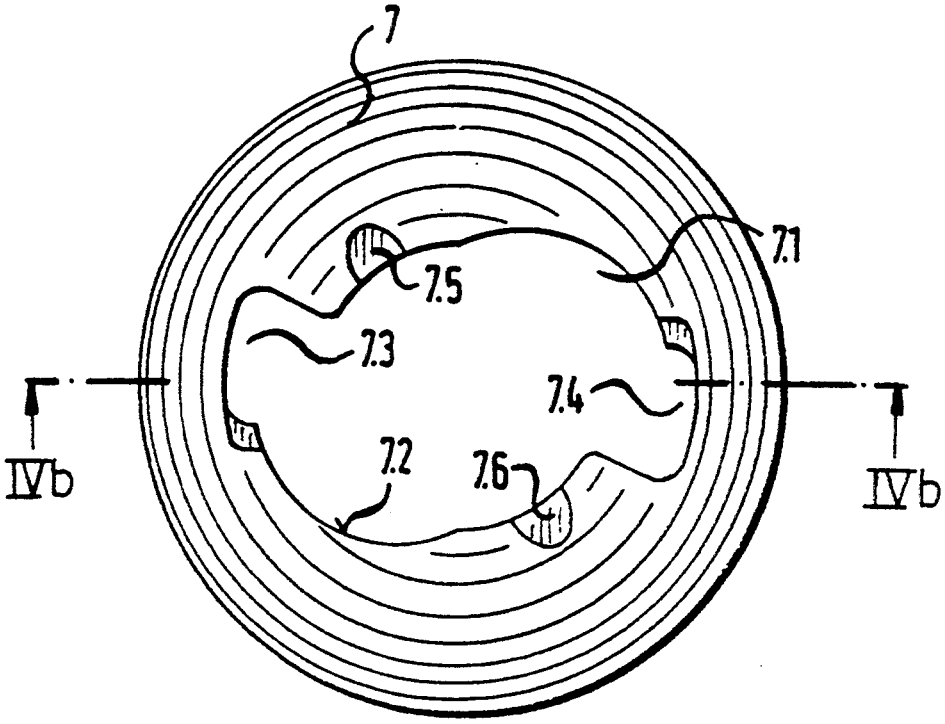

CONTACT ASSEMBLY FOR SELECTOR OF STEP TRANSFORMER

SPECIFICATION

1. Field of the Invention

The present invention relates to a step transformer. More particularly this invention concerns a contact assembly for such a transformer.

2. Background of the Invention

A standard step transformer has a drum formed as a cylindrical sleeve of insulating material that is provided with an array of contacts each constituted by a respective stud that passes through a respective hole in the drum. A selector is movable in the drum to bring movable contacts into engagement with the fixed contacts formed by the studs.

In the standard such arrangement as described in German patent 3,801,151 the metallic stud is fitted through an insulating washer and the outside portion, to which the lead going to the respective transformer tap is connected, is plastically widened to prevent the contact stud from pulling out of the insulating washer into the interior of the selector drum. This widening is done by enlarging holes in the outside part of the stud, although it is also known from German utility model 9,010,713 to simply upset the shaft of the stud, rivet fashion, to widen it and prevent it from pulling out.

Such a system has several disadvantages. To start with the physical process of enlarging the stud shaft requires that special-duty tools be employed, normally both on the outside and inside of the drum, to stabilize the stud during the widening operation. Furthermore the drum, which is invariably made of a synthetic resin, tends to shrink slightly as it ages, leaving the once tight studs slightly loose in their holes. When loose they become more difficult to make contact with and also expose their insulating bushings to wear. Finally it is impossible or very difficult to remove such a stud, since typically the stud must be destroyed to get it out of its hole. Thus repair or regular maintenance becomes expensive and difficult.

OBJECTS OF THE INVENTION

It is therefore an object of the present invention to provide an improved contact stud for a step transformer.

Another object is the provision of such an improved contact stud for a step transformer which overcomes the above-given disadvantages, that is which is easy to install, which remains tight once installed, and which can be removed and replaced without damage.

A further object is to provide an improved retaining system, in particular a holding washer, for such a contact assembly.

SUMMARY OF THE INVENTION

A step-transformer drum formed with throughgoing apertures each centered on a respective axis has a contact assembly in each aperture having an insulating washer lining the aperture and having an inside part lying on an inside surface of the drum and an outside part lying on an outside surface of the drum. A stud has an enlarged head bearing outward on the inside washer part and a shaft projecting through the washer past the outside washer part and formed outside the outside washer part with a transversely throughgoing hole. A pin extends transversely through the hole and bears inwardly on an outwardly directed ramp so that rotation of the stud and pin in one direction relative to the structure makes the pin ride up on the ramp and tightens the stud in the aperture and opposite relative rotation loosens the stud.

Thus with this system the stud is inserted through the washer, the pin is fitted through the stud, and the stud is twisted so the pin rides up on the ramp and locks the stud in place. Such assembly is extremely simple and also perfectly reversible to disassemble the device. No special tools are required and the assembly and disassembly are not stressful to the surrounding structure.

In accordance with this invention the structure forms two such ramps diametrically opposite each other relative to the respective axis. The pin has opposite ends each bearing on a respective one of the ramps. Each ramp is formed with at least one upstanding catch formation that inhibits backward movement of the pin once the pin has moved forward past it. In fact the ramps can be formed with rows of sawteeth each constituting a respective such catch formation.

The structure according to the invention can be unitarily formed on an outside face of the outside washer part. It is also possible for another washer engaged between the structure and the pin to have a face turned toward the structure and formed with another ramp complementary to the ramp of the structure. Furthermore the structure can be a retaining washer engaged between the pin and the outer washer part. This washer is frustoconically dished and has a substantially circular outer periphery and a noncircular inner periphery. The inner periphery is formed with diametrically opposite radially inwardly open notches dimensioned such that when they are axially aligned with the pin the retaining washer can be pulled off the stud past the pin. A cover can be engaged over the shaft and completely contain the pin, and can even itself constitute the ramp-forming structure.

BRIEF DESCRIPTION OF THE DRAWING

The above and other objects, features, and advantages will become more readily apparent from the following, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing:

FIG. 4*a* is a top view of a the retaining washer of FIG. 3;

FIG. 4*b* is a section taken along line IVb—IVb of FIG. 4*a*; and

SPECIFIC DESCRIPTION

Figure 1:
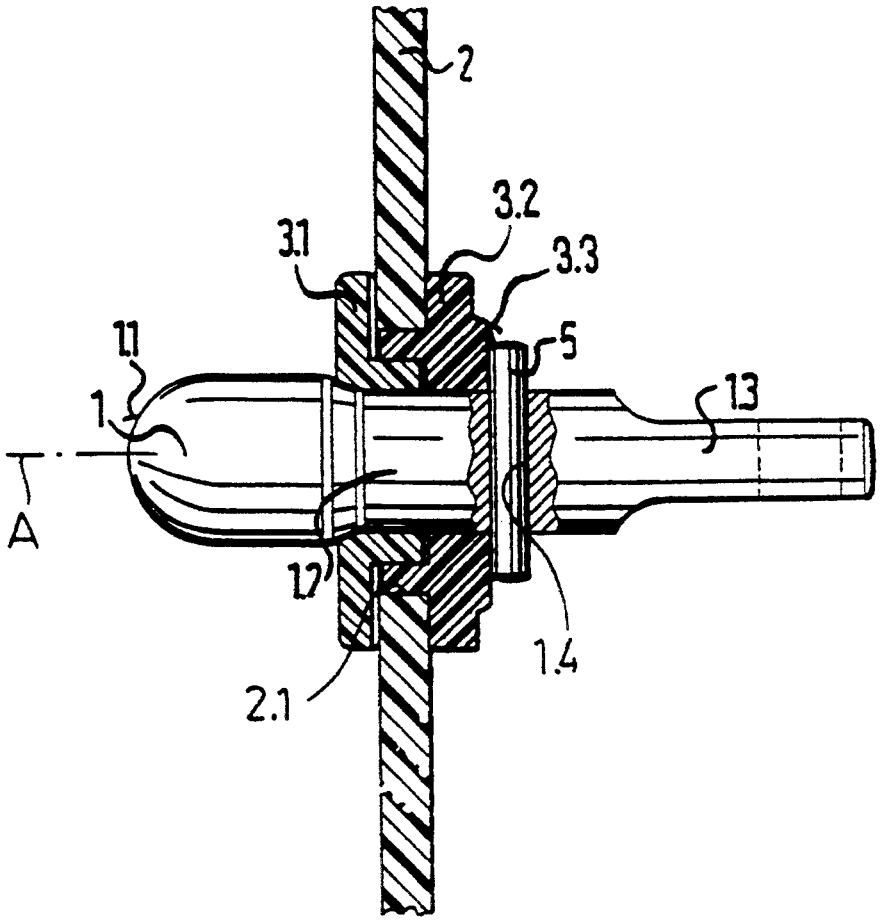
FIG. 1 is an axial section through a contact assembly according to the invention.

As seen in FIG. 1 a contact stud 1 extends along an axis A through a circular aperture 2.1 formed in a wall 2 of a cylindrical step-transformer drum. The axis A extends radially of the normally upright unillustrated central axis of this drum wall 2 which is normally formed with an array of such apertures 2.1. The stud i is of generally standard construction, having an enlarged bullet-shaped head 1.1, a smaller-diameter cylindrical shaft 1.2, and an outer end 1.3 adapted to be connected to an electrical wire leading to a respective transformer tap.

The aperture 2.1 is lined with a washer comprising an inner part 3.1 and an outer part 3.2, each having a flat circular disk lying on the respective face of the wall 2 and a cylindrically tubular extension fitting through the hole 2.1 with the two extensions telescoped together. Thus the shaft 1.2 of the stud 1 is insulated from the wall 2 which is itself made of insulating material.

Figure 1A:
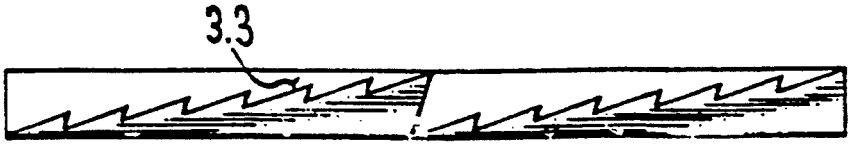
FIG. 1*a* is a developed view of a detail of the assembly of FIG. 1.

In accordance with this invention the outer surface of the outer washer part 3.2 is formed with a pair of 180° ramps 3.3 of sawtooth shape as shown in the developed view of FIG. 1*a*. In addition the shaft 1.2 is formed with a diametrally throughgoing hole 1.4 through which engages a glass-fiber reinforced plastic pin 5 whose ends engage the ramps 3.3.

Thus this stud 1 is mounted by pushing it through the central hole defined by the washer parts 3.1 and 3.2 and then inserting the pin 5 through it. The stud 1 is then rotated so the pin ends ride up on the ramps 3.3, axially locking the assembly in place. For disassembly the stud 1 is oppositely rotated, the pin 5 is pulled out when it is loose, and the stud 1 is withdrawn.

Figure 2:
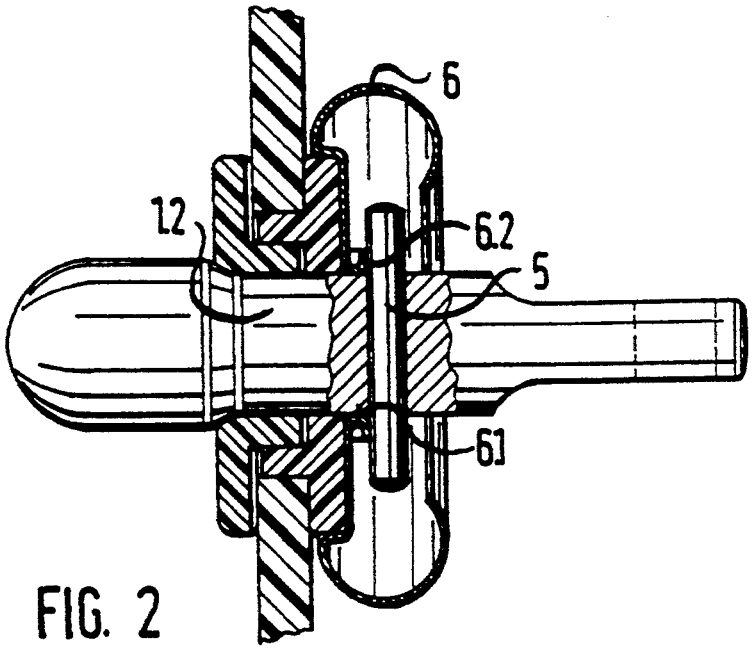
FIGS. 2 and 3 are views like FIG. 1 of other systems according to the invention.

In FIG. 2 a toroidal hollow shield 6 is provide having an inner edge 6.1 forming ramps 6.2 on which the pin 5 rides. Here the outer face of the outer washer part 3.2 is smooth.

Figure 3:
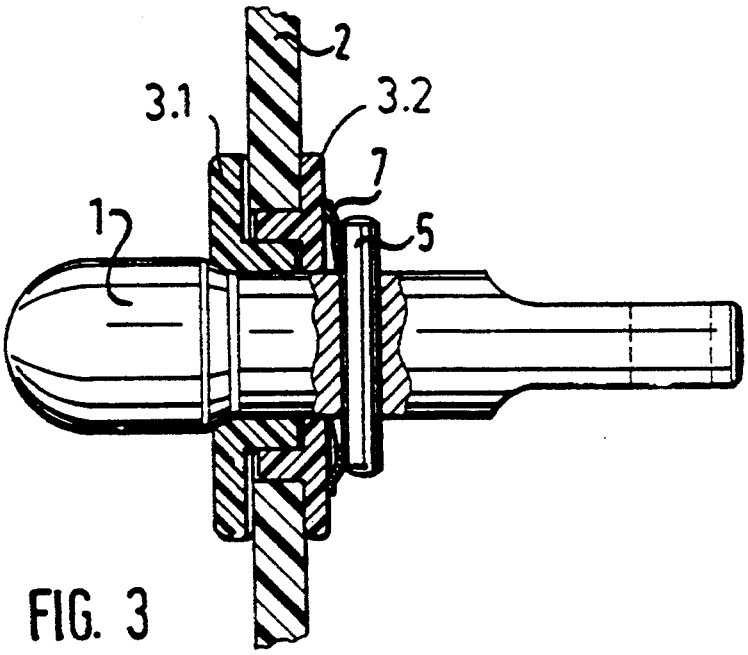

FIGS. 3, 4*a*, and 4*b* show an arrangement where a dished retaining washer 7 interposed between the pin 5 and outer washer part 3.2, which here is not formed with the ramp 3.3, has a central hole 7.1 with an inner periphery 7.2 forming the ramp. This periphery 7.2 is also formed with two diametrally opposite and inwardly open notches 7.3 and 7.4 so that the pin 5 can be pulled axially through the hole 7.1 while still in its hole 1.4, and is formed at the upper ends of the ramps with two diametrally opposite retaining notches 7.5 and 7.6. Thus when the stud 1 is twisted to lock it in place, the ends of the pin 5 will ride up on the periphery 7.2 and seat in the notches 7.5 and 7.6.

Figure 5:
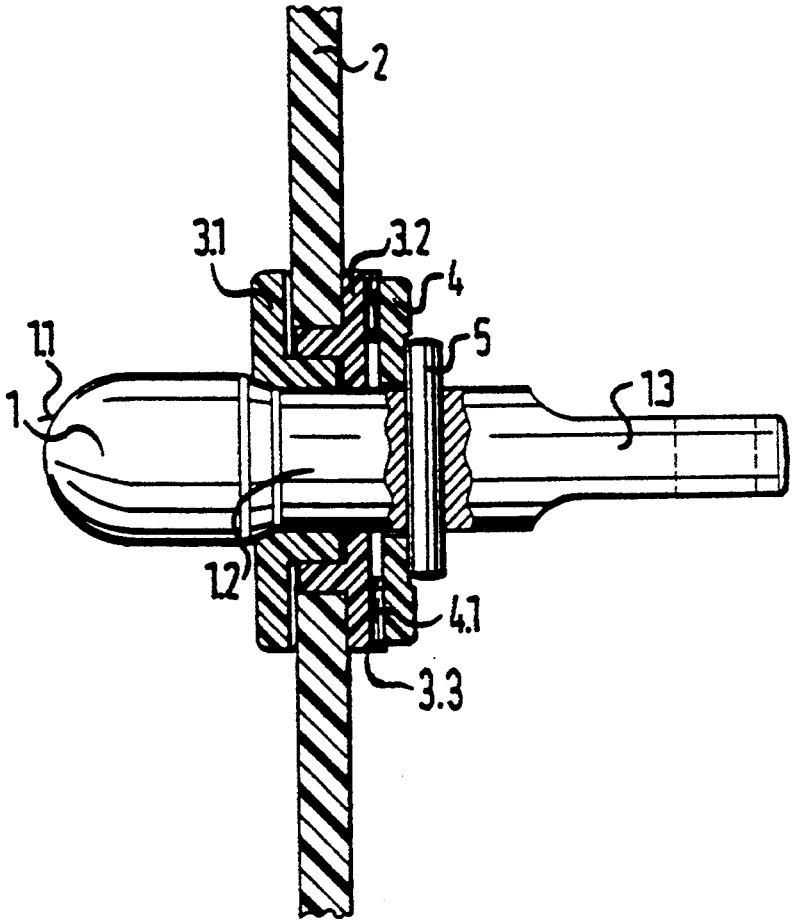
FIG. 5 is a view like FIG. 1 of another arrangement in accordance with this invention.

FIG. 5 shows a further arrangement where the pin 5 bears via another washer 4 on the ramps 3.3 of the outer washer part 3.2. To this end this washer 4 may itself be formed with ramps complementary to the ramps 3.3.

We claim:

1. In combination with a step-transformer drum formed with throughgoing apertures each centered on a respective axis, a contact assembly in each aperture comprising:

an insulating washer lining the aperture and having an inside part lying on an inside surface of the drum and an outside part lying on an outside surface of the drum;

a stud having an enlarged head bearing outward on the inside washer part and a shaft projecting through the washer past the outside washer part and formed outside the outside washer part with a transversely throughgoing hole;

a pin projecting transversely through the hole; and structure forming an outwardly directed ramp on which the pin bears inwardly, whereby rotation of the stud and pin in one direction relative to the structure makes the pin travel along the ramp and tightens the stud in the aperture and opposite relative rotation loosens the stud.

2. The step-transformer contact assembly defined in claim 1 wherein the structure forms two such ramps diametrically opposite each other relative to the respective axis, the pin having opposite ends each bearing on a respective one of the ramps.

3. The step-transformer contact assembly defined in claim 2 wherein each ramp is formed with at least one upstanding catch formation that inhibits backward movement of the pin once the pin has moved forward past it.

4. The step-transformer contact assembly defined in claim 2 wherein the ramps are formed with rows of sawteeth each constituting a respective such catch formation.

5. The step-transformer contact assembly defined in claim 1 wherein the structure is unitarily formed on an outside face of the outside washer part.

6. The step-transformer contact assembly defined in claim 1, further comprising another washer engaged between the structure and the pin and having a face turned toward the structure and formed with another ramp complementary to the ramp of the structure.

7. The step-transformer contact assembly defined in claim 1 wherein the structure is a retaining washer engaged between the pin and the outer washer part.

8. The step-transformer contact assembly defined in claim 7 wherein the washer is frustoconically dished and has a substantially circular outer periphery and a noncircular inner periphery.

9. The step-transformer contact assembly defined in claim 8 wherein the inner periphery is formed with diametrically opposite radially inwardly open notches dimensioned such that when they are axially aligned with the pin the retaining washer can be pulled off the stud past the pin.

10. The step-transformer contact assembly defined in claim 1, further comprising a cover engaged over the shaft and completely containing the pin.

11. In combination with a step-transformer contact assembly engaged through an aperture of a transformer drum, the contact assembly having an insulating washer lining the aperture and having an inside part lying on an inside surface of the drum and an outside part lying on an outside surface of the drum;

a stud having an enlarged head bearing outward on the inside washer part and a shaft projecting through the washer past the outside washer part and formed outside the outside washer part with a transversely throughgoing hole; and a pin projecting transversely through the hole, a retaining washer forming an outwardly directed ramp on which the pin bears inwardly, whereby rotation of the stud and pin in one direction relative to the structure makes the pin travel along the ramp and tightens the stud in the aperture and opposite relative rotation loosens the stud.

12. The retaining washer defined in claim 11 wherein the washer is frustoconically dished and has a substantially circular outer periphery and a noncircular inner periphery forming the ramp.

13. The retaining washer defined in claim 12 wherein the inner periphery is symmetrical to a plane including the axis so that the inner periphery forms two such ramps.

14. The retaining washer defined in claim 13 wherein each ramp is formed with at least one retaining recess.

* * * * *